United States Patent [19]

Minnick et al.

[11] Patent Number: 4,503,284

[45] Date of Patent: Mar. 5, 1985

[54] RF SUPPRESSING MAGNET WIRE

[75] Inventors: Michael G. Minnick; Robert O. Weisz, both of Fort Wayne, Ind.

[73] Assignee: Essex Group, Inc., Fort Wayne, Ind.

[21] Appl. No.: 550,279

[22] Filed: Nov. 9, 1983

[51] Int. Cl.[3] ..... H01B 11/06

[52] U.S. Cl. ..... 174/36; 174/102 SC; 174/110 N; 174/120 SC

[58] Field of Search ..... 174/36, 102 SC, 102 C, 174/120 SC, 110 N; 343/18 A; 333/12

[56] References Cited

U.S. PATENT DOCUMENTS

| | | | |
|---|---|---|---|
| 1,784,989 | 12/1930 | Hill . | |
| 2,933,457 | 4/1960 | Steinberg | 252/511 |
| 3,191,132 | 6/1965 | Mayer | 333/79 |
| 3,546,017 | 12/1970 | Pendleton et al. | 117/232 |
| 3,569,611 | 3/1971 | Berends | 174/120 SC X |
| 3,577,346 | 6/1971 | McKeown | 252/63.5 |
| 3,617,379 | 11/1971 | Ulmer et al. | 117/224 |
| 3,793,476 | 2/1974 | Misiura et al. | 174/102 SC |
| 4,038,660 | 7/1977 | Connolly et al. | 343/18 A |
| 4,196,464 | 4/1980 | Russell | 174/102 SC X |
| 4,233,191 | 11/1980 | Reuter et al. | 252/511 |
| 4,287,243 | 9/1981 | Nielsen | 343/18 A X |
| 4,301,428 | 11/1981 | Mayer | 174/36 X |
| 4,303,457 | 12/1981 | Johansen et al. | 174/102 SC X |
| 4,317,001 | 2/1982 | Silver et al. | 174/102 SC |
| 4,337,179 | 6/1982 | Uejo et al. | 252/511 |
| 4,371,742 | 2/1983 | Manly | 174/36 |
| 4,383,225 | 5/1983 | Mayer | 174/36 X |
| 4,400,430 | 8/1983 | Miyake et al. | 174/110 N |

FOREIGN PATENT DOCUMENTS

| | | | |
|---|---|---|---|
| 2050913 | 4/1972 | Fed. Rep. of Germany | 174/36 |
| 31593 | 10/1979 | Japan | 174/120 C |
| 2084385A | 4/1982 | United Kingdom | 174/36 |

*Primary Examiner*—A. T. Grimley
*Assistant Examiner*—Morris H. Nimmo
*Attorney, Agent, or Firm*—Alan C. Cohen

[57] ABSTRACT

RF absorbing magnet wire is disclosed made up of an electrical conductor such as copper or aluminum coated with at least one layer of polymeric insulation containing electrically and/or magnetically conductive particles. The wire may be made up of a plurality of insulating layers with the particles in the outermost layer. Such magnet wire will aid in eliminating RF interference where certain RF sensitive components, i.e. microprocessors, radios, etc. may be affected.

1 Claim, 4 Drawing Figures

RF SUPPRESSING MAGNET WIRE

TECHNICAL FIELD

The field of art to which this invention pertains is insulated magnet wire, and specifically multilayered insulated magnet wire.

BACKGROUND ART

Electromagnetic devices fabricated from coiled magnet wire can generate significant levels of radio frequency (RF) signals when subjected to rapidly fluctuating voltages. When operating such devices in the same environment as digital and analog electronic devices such as microprocessors, radio frequency receiving and/or broadcasting equipment—such as radios and/or citizen band transmitters—such RF signals can seriously impair the performance of these digital and analog electronics. One method commonly used for suppressing RF signals from electromagnetic devices is the inclusion of a diode in the circuit of the coil or other electromagnetic device which suppresses such radio frequency signals. However, the introduction of the diode adds significant cost to and results in a relatively complex, electromagnetic device. Accordingly, what is needed in this art is a way of controlling radio frequency signals generated by electromagnetic devices, which is less complicated, more durable, less costly but yet effective.

DISCLOSURE OF INVENTION

The present invention is directed toward magnet wire coated with at least one layer of polymeric insulation modified to impart semiconductive or magnetic properties or a combination of both to at least one of the polymeric layers. These properties are accomplished through the incorporation of conductive and/or magnetic particles into the polymeric coating.

Other features and advantages will be apparent from the specification and claims and from the accompanying drawings which illustrate an embodiment of the invention.

BEST MODE FOR CARRYING OUT THE INVENTION

Figure 1:
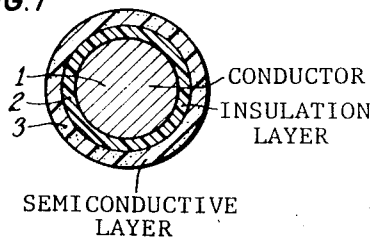
FIG. 1 shows a magnet wire according to the present invention.

As may be seen in FIG. 1, the present invention comprises an electrically conductive wire 1 coated with an electrical insulation layer 2 overcoated with a polymeric semiconductive insulation 3 containing electrically conductive and/or magnetic particles 4. The electrically conductive wire 1 may be comprised of any electrically conductive materials such as aluminum or copper, copper being the preferred material. Any gauge wire may be used. Typically, these gauges will be from about AWG-4 to about AWG-46 with the preferred range being about AWG-15 to about AWG-39.

The wire is initially coated with a conventional magnet wire polymeric insulation, i.e. polyurethane, polyester polyamide imide, or polyamide to a thickness representing from about 30% to about 95% of the overall thickness of the final coating of the wire. The choice of which polymeric insulation material to use depends on its compatibility with the semiconductive layer and the temperature to which the particular wire will be exposed. The application of the insulating coating may be performed in a single step or multiple step process. This coating process, as well as all the other coating processes described in this application, may be performed by any conventional technique, i.e. enamel application-oven cure, extrusion, etc.

The balance of the wire coating, from about 5% to about 70% of the total coating thickness, comprises an electrically and/or a magnetically modified polymeric coating. The polymer matrix which forms the basis for this coating may be selected from any polymeric material conventionally used in this art. Such conventional wire polymers including polyester, polyamid (e.g. nylon), polyamide imide, polyurethane etc. are generally used. The specific polymer chosen depends on its compatibility with the underlying insulating polymer over which it is being applied. In addition, the polymer must exhibit the desired thermal and mechanical properties required of an acceptable wire coating. Nylon in any of its common forms, i.e. nylon 6, nylon 6,6, nylon 6,12 etc., or the urethane modified version of these are the preferred materials. The preferred materials are urethane modified nylons, i.e. P. D. George 641 (P. D. George Co., St. Louis Mo.) or SX-15501 (Essex Wire Co., Ft. Wayne Ind.).

Conductive and/or magnetic particles are added to the polymeric matrix material to form a semiconductive coating which is then applied to the previously insulated wire. The particle size, aspect ratio and concentration of the particles employed should be judiciously chosen to produce a film which will suppress the RF signals generated by electromagnetic devices. The term suppression in this context is defined as the capability of highly attenuating RF signals which are observed during the operation of an electromagnetic device. Although it is not fully understood how the semiconductive layer achieves this suppression, it has been found that films having a resistivity from about 0.1 to about $1\times10^3$ ohm-centimeters will suppress from about 10% to about 99% of these RF signals.

In general, depending on the above-mentioned criteria, the particles represent about 10% to about 40% by weight loading of the cured coating, with about 30% being preferred. Also, while the term particle is used, it can be appreciated that this term is meant to include any particulate additive which will produce the semiconducting effect including, but not limited to, powder, fibers, flakes, etc. Typically electrically conductive particles which are useful in practicing this invention include, but should not be limited to, carbon black particles, carbon fibers, graphite particles, graphite fibers, metal powders or flakes, metallized glass fibers, polyacrylonitrile, carbon fibers, etc. A typical magnetic material which may be used to practice this invention would be a Ferro-magnetic material such as ferrite powder. Such magnetic materials may be characterized as having intrinsic magnetic anisotropy.

The conductive and/or magnetic material having been mixed with the chosen polymer matrix is then applied to the previously insulated (already carrying at least one insulation layer) wire to the desired thickness. This application may be by any conventional technique either in one step or multiple applications.

In general, the radio frequency signals generated by electromagnetic devices can be suppressed by as much as about 10% to about 99% over specific radio frequency ranges. Generally, these radio frequencies range from about 100 KHz to about 100 MHz.

An example of a typical semiconducting formulation, in percent by weight of ingredients, useful for fine wire application for (AWG-4 to AWG-46) is as follows:

TABLE I

| | |
|---|---|
| Urethane modified nylon resin | 4%-5% |
| Carbon black | 2.5%-3.5% |
| Aromatic hydrocarbon solvent | 17%-19% |
| Cresylic acid | 18%-20% |
| Phenol | 54%-56% |
| Polymeric dispersant (optional) | 1%-1.5% |

The percent carbon black based on the solid formation of the cured semiconductive coating of the above formulation is about 28% to about 30%. It has been determined that such cured semiconductive coatings, approximately 5 mils in thickness, exhibit a volume resistivity of about 1 to about 2 ohms centimeter.

EXAMPLE

A formulation and preparation of the semiconducting coating used to prepare experimental coils is described below.

A semiconducting particle dispersion of carbon black to be added to a polymer matrix to form the semiconductive coating was manufactured as follows. All the ingredients were combined in weight percent.

15% Degussa Printex L® carbon black having an average particle size of 23 nm and a surface area as determined by the BET method of $150^2$ m/gm.
15% DuPont Alkanol DOA® dispersant having 43% solids.
43.5% Phenol
14.5% Cresylic Acid
12% Xylene This composition was then ball milled for several hours to homogenize the dispersion.

A separate mixture of the polymer matrix was prepared as follows:

46.0% urethane modified nylon, (SX-15501)
31.6% phenol
10.5% cresylic acid, and
11.9% xylene Once the above mixture was homogenized by stirring; enough of the particle dispersion of carbon black material was added to constitute 19.2% of the overall mixture. This combination was then blended in a high speed mixer until homogenized. The resulting dried coating had as a distribution of its solids composition the following:

urethane modified nylon—56-59%
carbon black—29-31%
alkanol DOA dispersant—12-13%

An electromagnetic coil was then prepared using the above coating in the following manner:

A 39 AWG copper wire was coated with a polyurethane polymer basecoat (XWE-1284 available from Schenectedy Chemical Company) to a thickness of 0.00035 inch using a conventional enamel application oven-curing technique. A semiconductive layer comprised of the above described semiconductive mixture was applied to the basecoat to a thickness of 0.00015 inch using the same enamel application oven-curing technique. After the wire was coated, a coil of the wire was formed for use in a typical buzzer assembly such as those found in automobiles.

Figure 2:
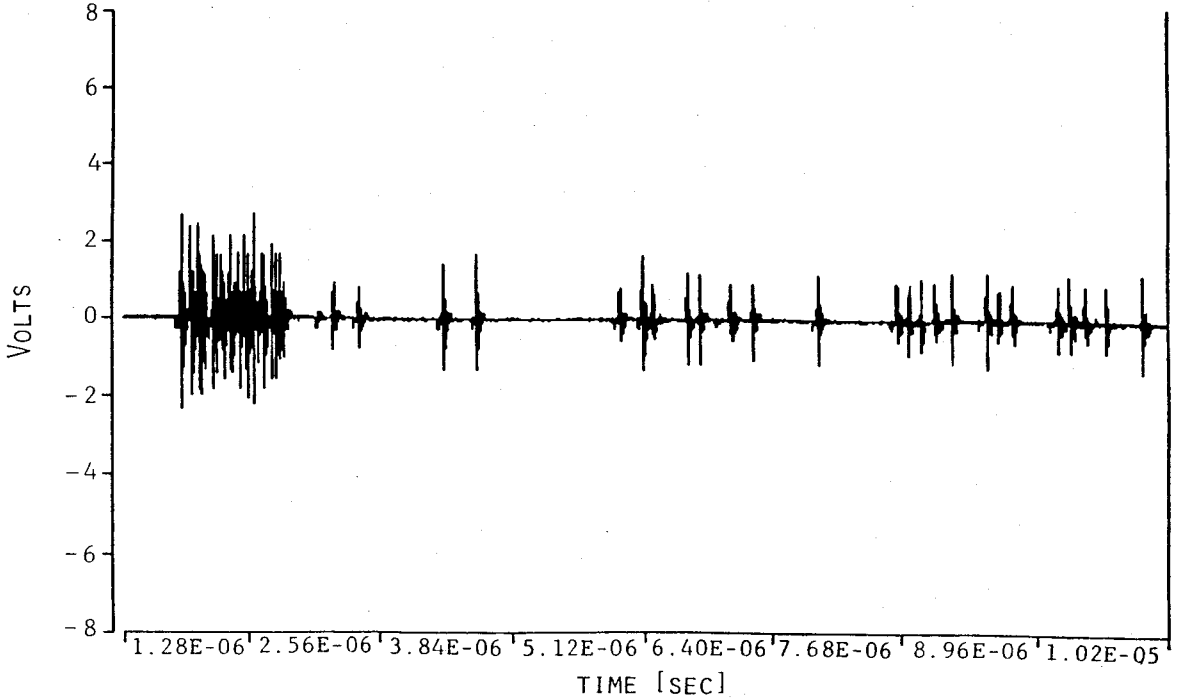
FIG. 2 illustrates transient electrical signals generated within a standard buzzer coil following a rapid voltage fluctuation.
Figure 3:
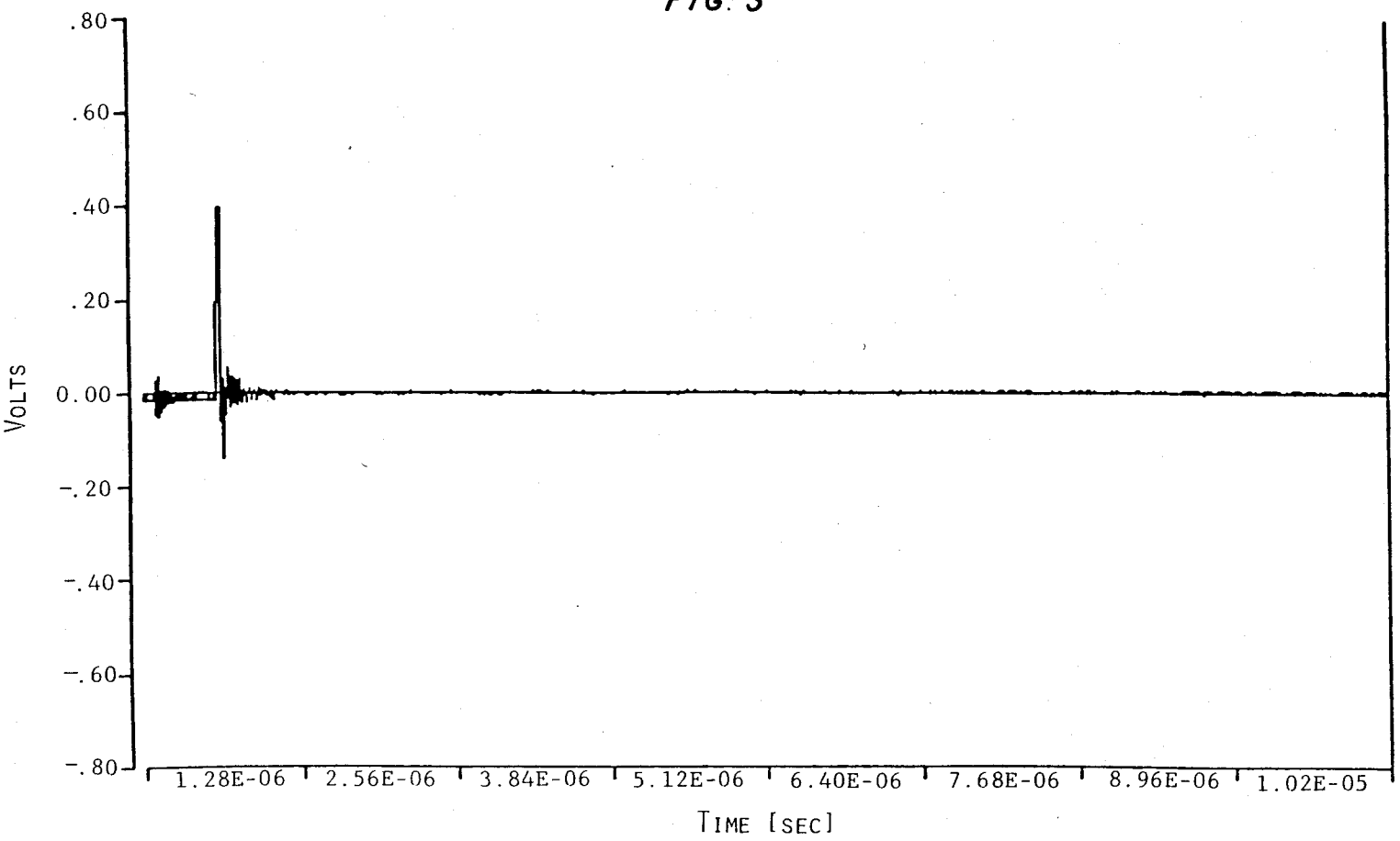
FIG. 3 illustrates the effect of using a diode suppressor on electrical signals generated within a standard buzzer coil following a rapid voltage fluctuation.
Figure 4:
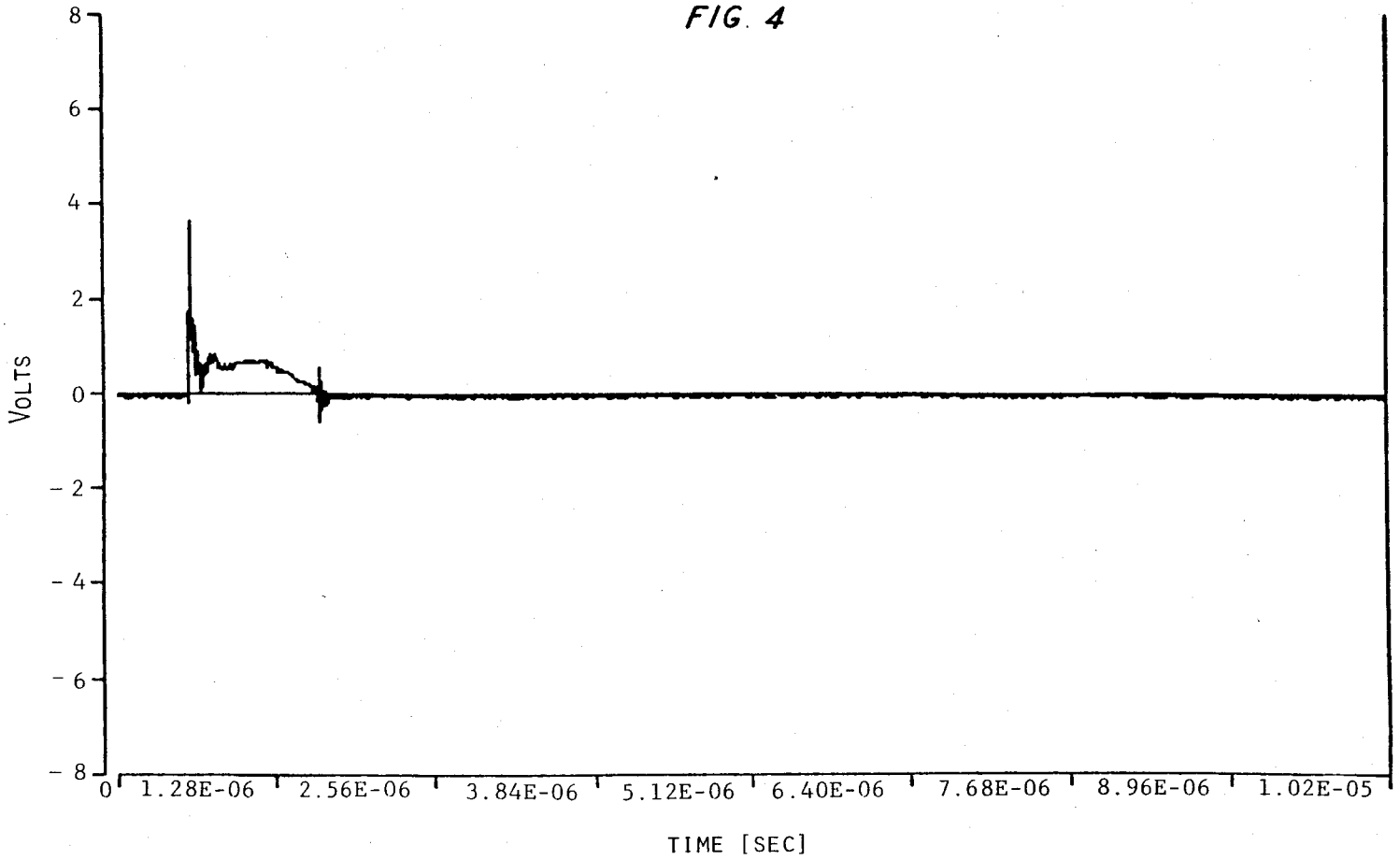
FIG. 4 illustrates the effect of the present inventive wire in suppressing transient electrical signals generated within a standard buzzer coil following a rapid voltage fluctuation.

The buzzer assembly was then tested to determine the effectiveness of the RF suppression of the wire having the semiconductive insulating layer. For comparison purposes, a standard buzzer coil without the semiconductive layer, as well as a buzzer coil having a diode attached were also tested. The results of the RF suppression tests are best demonstrated in FIG. 2, FIG. 3 and FIG. 4. To determine the suppression effectiveness of the present invention, a test was performed wherein a buzzer was connected to a recording device which could detect RF disruption in an electrical current. The recording device would record how long, once the buzzer was turned off, the RF interference continued to be detected.

As can be seen in the three Figures, the X axis is designated as time in microseconds and the Y axis is a measure of the intensity of the interference. It is quite clear from comparing these graphic results, that the RF suppression properties of the present invention are comparable to the system requiring the use of a diode.

Coatings such as these have any number of useful applications in magnet wire systems. The most immediate use at the present time is in automobile systems where voltage fluctuations are very common and electrical interference causes problems with radio receivers, CB units, mobile telephones, etc.

At the present time, this interference is reduced by the use of diodes in the system. However, these diodes are fragile and expensive. The use of wire coatings of the present invention will allow for simple, less expensive ways to cope with this problem.

It should be understood that the invention is not limited to the particular embodiments shown and described herein, but that various changes and modifications may be made without departing from the spirit and scope of this novel concept as defined by the following claims.

I claim:

1. An insulating magnet wire comprising an electrical conductor coated with at least one layer of electrically insulating polyurethane material, said layer overcoated with a semiconductive layer of polyurethane modified nylon containing about 10 percent to about 40 percent by weight of electrically conductive carbon black particles, said semiconductive layer having a volume resistivity of about 0.1 ohm-centimeter to about 1000 ohm-centimeter and capable of suppressing radio frequency signals from about 100 KHz to about 100 MHz.

* * * * *